US009478860B2

(12) United States Patent
Lin et al.

(10) Patent No.: US 9,478,860 B2
(45) Date of Patent: Oct. 25, 2016

(54) MULTIBAND ANTENNA

(71) Applicant: Chiun Mai Communication Systems, Inc., New Taipei (TW)

(72) Inventors: Te-Chang Lin, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 446 days.

(21) Appl. No.: 14/018,553

(22) Filed: Sep. 5, 2013

(65) Prior Publication Data

US 2015/0002339 A1 Jan. 1, 2015

(30) Foreign Application Priority Data

Jun. 28, 2013 (TW) ..... 102123338

(51) Int. Cl.
*H01Q 9/04* (2006.01)
*H01Q 5/00* (2015.01)

(52) U.S. Cl.
CPC ..... *H01Q 5/0058* (2013.01); *H01Q 5/0062* (2013.01); *H01Q 9/0414* (2013.01); *H01Q 9/0421* (2013.01)

(58) Field of Classification Search
CPC ..... H01Q 9/04
USPC ..... 343/700 MS
See application file for complete search history.

(56) References Cited

U.S. PATENT DOCUMENTS

2010/0315294 A1* 12/2010 Chang ..... H01Q 1/38 343/700 MS

* cited by examiner

*Primary Examiner* — Dameon E Levi
*Assistant Examiner* — Andrea Lindgren Baltzell
(74) *Attorney, Agent, or Firm* — Zhigang Ma

(57) ABSTRACT

A multiband antenna includes a feed end, a first grounding end, a first main portion connected to the feed end, a second main portion, a first radiating portion, a second radiating portion, and a third radiating portion. The second main portion is coplanar with and connected to the first main portion. The first radiating portion is connected to a first edge of the second main portion opposite to the first main portion. The second radiating portion is connected to the first edge of the second main portion and spaced form the first radiating portion. The third radiating portion is connected to a second edge of the second main portion opposite to the first radiating portion. The first grounding end is connected to the third radiating portion.

18 Claims, 2 Drawing Sheets

MULTIBAND ANTENNA

BACKGROUND

1. Technical Field

The present disclosure relates to antennas, particularly to a multiband antenna.

2. Description of Related Art

Antennas are important elements of wireless communication devices (such as mobile phones). A typical antenna includes a feeding end, a ground end, and a radiating portion for receiving and/or transmitting wireless signals. By slightly adjusting the structure, the antenna can receive and/or transmit wireless signals of different frequency bands, such as GSM850, GSM900, and WCDMA. However, it is a challenge to design a multiband antenna for receiving and/or transmitting wireless signals of GSM850, GSM900, and WCDMA frequency bands, as well as signals of Long Term Evolution bands (2170 MHz-2600 MHz).

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
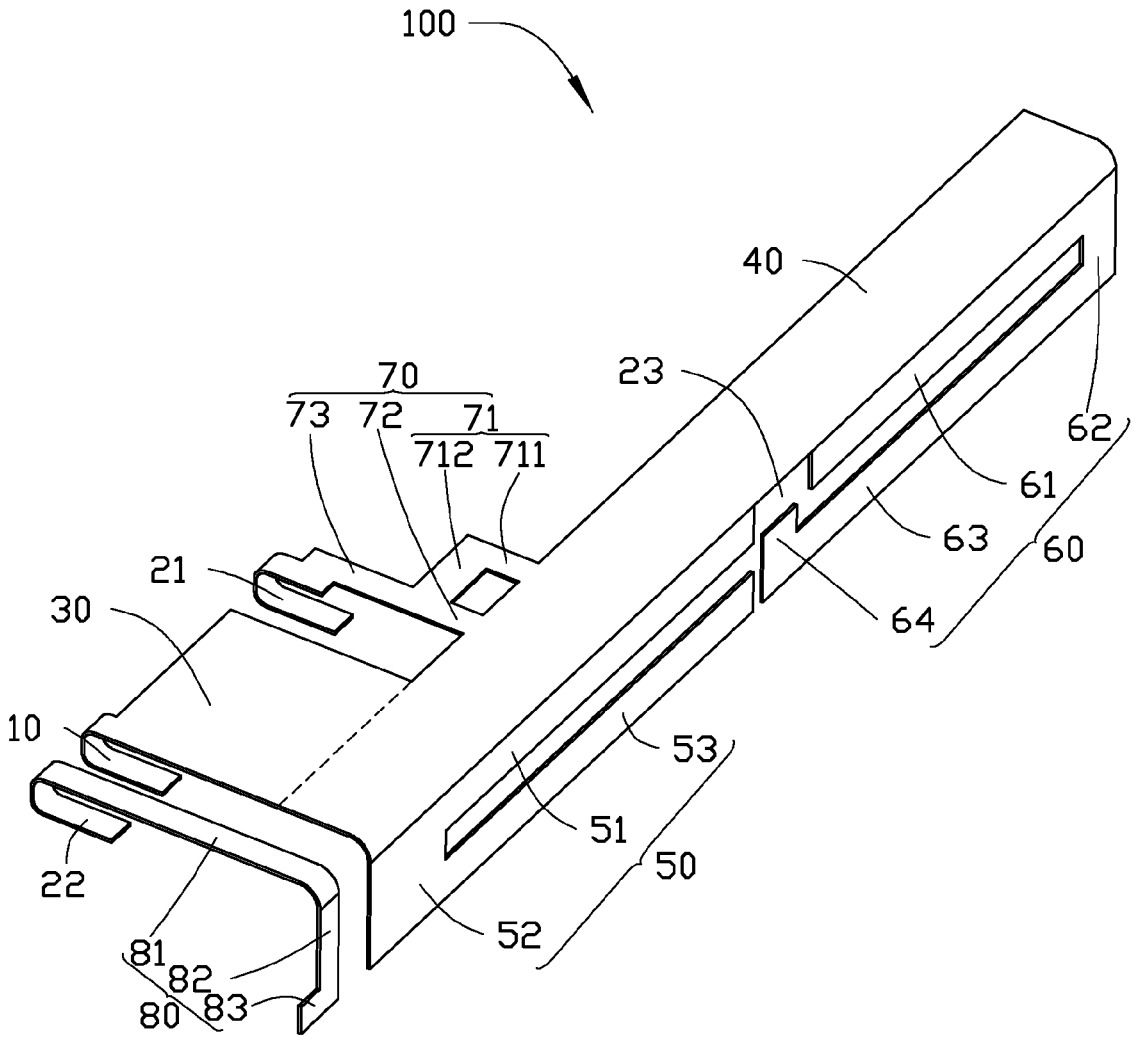
FIG. 1 is an isometric view of a multiband antenna in accordance with an exemplary embodiment.

FIG. 1 shows an exemplary embodiment of a multiband antenna 100. The multiband antenna 100 is employed in wireless communication devices, such as mobile phones and tablet computers. The multiband antenna 100 includes a feeding end 10, a first grounding end 21, a second grounding end 22, a first main portion 30, a second main portion 40, a first radiating portion 50, a second radiating portion 60, a third radiating portion 70, and fourth radiating portion 80.

The first main portion 30 is substantially a rectangular planar sheet. The feeding end 10 is connected to an end of the first main portion 30 and extends beneath the first main portion 30 to be parallel to the first main portion 30.

The second main portion 40 is substantially a rectangular planar sheet and coplanar with the first main portion 30. The second main portion 40 extends transversely from another opposite end of the first main portion 30 away from the feeding end 10, thus the second main portion 40 and the first main portion 30 cooperatively form an "L" shape.

The first radiating portion 50 includes a first section 51, a second section 52, and a third section 53. The first, second, and third sections 51, 52, and 53 are coplanar. The first section 51 extends perpendicularly from a first edge of the second main portion 40 opposite to the first main portion 30. The third section 53 is parallel to and spaced from the first section 51. The second section 52 is positioned between and connected to an end of each of the first and third sections 51, 53, thereby forming a "U" shape by the first, second, and third sections 51, 52, and 53.

The second radiating portion 60 includes a first portion 61, a second portion 62, a third portion 63, and a fourth portion 64. The first portion 61, the second portion 62, the third portion 63, and the fourth portion 64 are coplanar. The first portion 61 extends perpendicularly from the first edge of the second main portion 40. The first portion 61 is spaced from the first section 51, thereby forming a gap 23 between the first portion 61 and the first section 51. The third portion 63 is parallel to and spaced from the first portion 61. The third portion 63 is slightly longer than the first portion 61. The second portion 62 is positioned between and is connected to the ends of the first and third portions 61, 63 away from the first radiating portion 50. The second portion 62 is perpendicular to the first and third portions 61, 63. The fourth portion 64 extends perpendicularly from an end of the third portion 63 adjacent to the first radiating portion 50. The fourth portion 64 extends towards to the gap 23 to be aligned with the gap 23.

The third radiating portion 70 is configured for receiving and/or transmitting signals of LTE band having a central frequency of about 2170 MHz to about 2600 MHz. The third radiating portion 70 includes a first extending section 71, a second extending section 72, and a third extending section 73. The first extending section 71, the second extending section 72, and the third extending section 73 are coplanar. The first extending section 71 includes a first sheet portion 711 and a second sheet portion 712. The first sheet portion 711 and the second extending section 72 are parallel to and spaced from each other. The first sheet portion 711 and the second extending section 72 both extend perpendicularly from a second edge of second main portion 40 opposite to the first radiating portion 50. That is, the first main portion 30, the first sheet portion 711, and the second extending section 72 are connected to the same edge of the second main portion 40. The second sheet portion 712 is positioned between and is connected to the ends of the first sheet portion 711 and the second extending section 72 away from the second main portion 40. The second sheet portion 712 is perpendicular to the first sheet portion 711 and the second extending section 72. The third extending section 73 extends longitudinally from the end of the second extending section 72 away from the second main portion 40 to be collinear with the second extending section 72. The first grounding end 21 is connected to an end of the third extending section 73 away from the second extending section 72 and extends beneath the third extending section 73 to be parallel to the third extending section 73.

The fourth radiating portion 80 is spaced from the first main portion 30 and the first radiating portion 50. The fourth radiating portion 80 includes a first extending portion 81, a second extending portion 82, and a third extending portion 83. The first extending portion 81 is spaced from and parallel to the first main portion 30. The first extending portion 81 is coplanar with the first main portion 30. The second extending portion 82 extends perpendicularly from an end of the first extending portion 81 to be parallel to the second section 52 of the first radiating portion 50. The third extending portion 83 is coplanar with the second extending portion 82 and extends perpendicularly from an end of the second extending portion 82 away from the first extending portion 81 to be located at a side of the second extending portion 82 away from the second section 52. The second grounding end 22 is connected to an opposite end of the first extending portion 81 away from the second extending portion 82 and extends beneath the first extending portion 81 to be parallel to the first extending portion 81. The fourth radiating portion 80 is configured for lengthen an electric current path, thereby widening the bandwidth of the multiband antenna 100.

The operating principle of the multiband antenna 100 is as follows.

Figure 2:
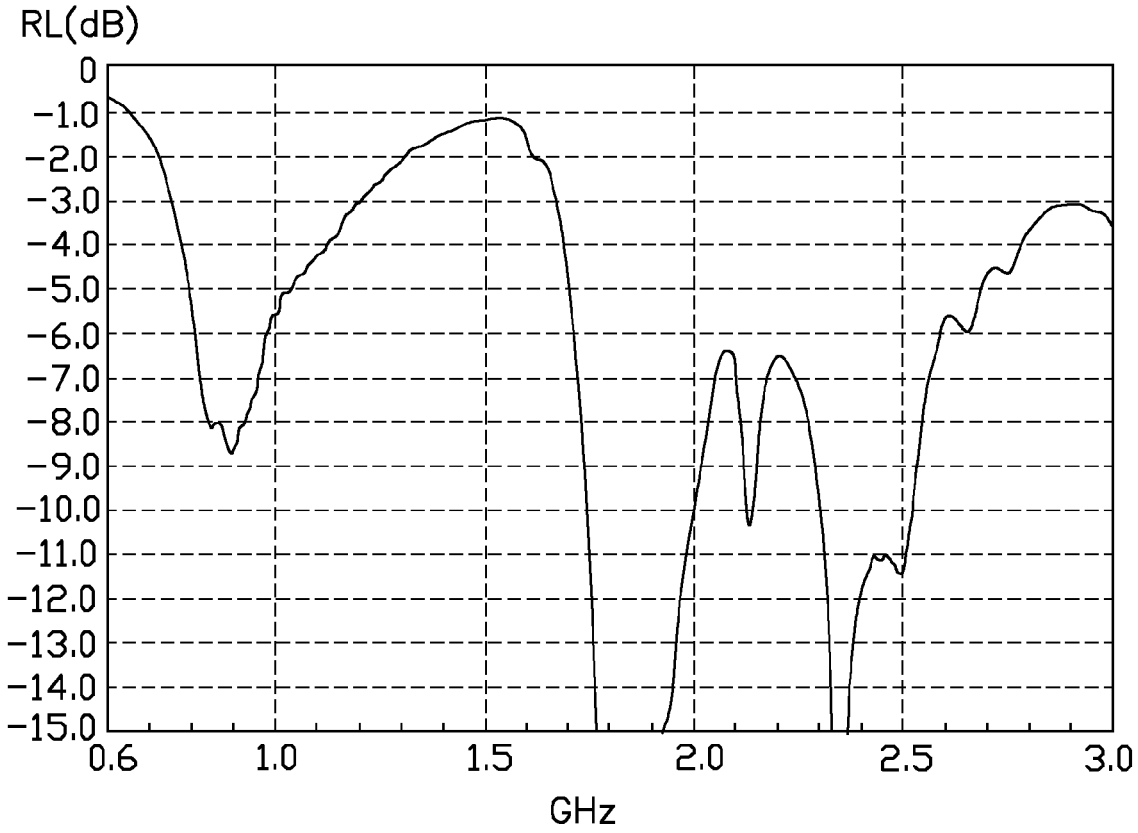
FIG. 2 is a diagram of measuring a return loss (RL) of the multiband antenna shown in FIG. 1, in multiple working frequency bands.

When electric current is fed into the feed end 10, the electric current flows through the first main portion 30. A first proportion of the electric current then flows into the first radiating portion 50 through the second main portion 40 to excite a first resonance mode to receive and/or transmit wireless signals in central frequencies of 1710 MHz-2170 MHz. The fourth radiating portion 80 couples with the first main portion 30, the second main portion 40, and the second section 52, inducing an electric current in the fourth radiating portion 80. The induced electric current is grounded through the second grounding end 22, thereby widening the bandwidth of the first resonance mode. A second proportion of the electric current then flows into the second radiating portion 60 through the second main portion 40 to excite a second resonance mode to receive and/or transmit wireless signals in central frequencies of 824 MHz-894 MHz. A third proportion of the electric current then flows into the third radiating portion 70 through the second main portion 40 to excite a third resonance mode to receive and/or transmit wireless signals in central frequencies of 2520 MHz-2600 MHz. FIG. 2 shows that when the multiband antenna 100 is used to receive and/or transmit wireless signals in central frequencies of 824 MHz-894 MHz, 1710 MHz-2170 MHz, and 2520 MHz-2600 MHz, the multiband antenna 100 has a high receiving and transmitting efficiency.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A multiband antenna, comprising:

a feed end;

a first grounding end;

a first main portion connected to the feed end;

a second main portion coplanar with and connected to the first main portion;

a first radiating portion connected to a first edge of the second main portion opposite to the first main portion;

a second radiating portion connected to the first edge of the second main portion and spaced from the first radiating portion; and a third radiating portion connected to a second edge of the second main portion opposite to the first radiating portion, the third radiating portion connected to the first grounding end;

wherein the third radiating portion comprises a first extending section and a second extending section coplanar with each other, the first extending section comprises a first sheet portion and a second sheet portion, the first sheet portion and the second extending section are spaced from each other and both extend perpendicularly from the second edge of second main portion, the second sheet portion is positioned between and connected to ends of the first sheet portion and the second extending section away from the second main portion, thereby the first sheet portion, the second sheet portion, the second extending section and the second main portion enclose a close slot.

2. The multiband antenna as claimed in claim 1, wherein the first main portion is substantially a rectangular planar sheet; the feeding end is connected to an end of the first main portion and extends beneath the first main portion to be parallel to the first main portion.

3. The multiband antenna as claimed in claim 2, wherein the second main portion extends transversely from an opposite end of the first main portion away from the feeding end, thus the second main portion and the first main portion cooperatively form an "L" shape.

4. The multiband antenna as claimed in claim 3, wherein the first radiating portion includes a first section, a second section, and a third section; the first, second, and third sections are coplanar; the first section extends perpendicularly from the first edge of the second main portion; the third section is parallel to and spaced from the first section; the second section is positioned between and is connected to an end of each of the first and third sections.

5. The multiband antenna as claimed in claim 4, wherein the second radiating portion includes a first portion, a second portion, and a third portion; the first portion, the second portion, and the third portion are coplanar; the first portion extends perpendicularly from the first edge of the second main portion; the first portion is spaced from the first section of the first radiating portion, thereby forming a gap between the first portion and the first section; the third portion is parallel to and spaced from the first portion; the second portion is positioned between and is connected to ends of the first and third portions away from the first radiating portion; the second portion is perpendicular to the first and third portions.

6. The multiband antenna as claimed in claim 5, wherein the second radiating portion further comprises a fourth portion extending perpendicularly from an end of the third portion adjacent to the first radiating portion; the fourth portion extends towards to the gap.

7. The multiband antenna as claimed in claim 4, further comprising a second grounding end and a fourth radiating portion; wherein the fourth radiating portion includes a first extending portion, a second extending portion, and a third extending portion; the first extending portion is spaced from and parallel to the first main portion; the second extending portion extends perpendicularly from an end of the first extending portion to be parallel to the second section; the third extending portion is coplanar with the second extending portion and extends perpendicularly from an end of the second extending portion away from the first extending portion to be located at a side of the second extending portion away from the second section; the second grounding end is connected to an opposite end of the first extending portion away from the second extending portion.

8. The multiband antenna as claimed in claim 1, wherein the third radiating portion further comprises a third extending section extending longitudinally from the end of the second extending section away from the second main portion to be collinear with the second extending section; the first grounding end is connected to an end of the third extending section away from the second extending section.

9. The multiband antenna as claimed in claim 1, wherein the first radiating portion receives and transmits wireless signals in central frequencies of 1710 MHz-2170 MHz; the second radiating portion receives and transmits wireless signals in central frequencies of 824 MHz-894 MHz; the third radiating portion receives and transmits wireless signals in central frequencies of 2520 MHz-2600 MHz.

10. A wireless communication device, comprising:

a multiband antenna, comprising:

a feed end;

a first grounding end;

a first main portion connected to the feed end;

a second main portion coplanar with and connected to the first main portion;

a first radiating portion connected to a first edge of the second main portion opposite to the first main portion;

a second radiating portion connected to the first edge of the second main portion and spaced from the first radiating portion; and a third radiating portion connected to a second edge of the second main portion opposite to the first radiating portion, the third radiating portion connected to the first grounding end;

wherein the third radiating portion comprises a first extending section and a second extending section coplanar with each other, the first extending section comprises a first sheet portion and a second sheet portion, the first sheet portion and the second extending section are spaced from each other and both extend perpendicularly from the second edge of second main portion, the second sheet portion is positioned between and connected to ends of the first sheet portion and the second extending section away from the second main portion, thereby the first sheet portion, the second sheet portion, the second extending section and the second main portion enclose a close slot.

11. The wireless communication device as claimed in claim 10, wherein the first main portion is substantially a rectangular planar sheet; the feeding end is connected to an end of the first main portion and extends beneath the first main portion to be parallel to the first main portion.

12. The wireless communication device as claimed in claim 11, wherein the second main portion extends transversely from an opposite end of the first main portion away from the feeding end, thus the second main portion and the first main portion cooperatively form an "L" shape.

13. The wireless communication device as claimed in claim 12, wherein the first radiating portion includes a first section, a second section, and a third section; the first, second, and third sections are coplanar; the first section extends perpendicularly from the first edge of the second main portion; the third section is parallel to and spaced from the first section; the second section is positioned between and connected to an end of each of the first and third sections.

14. The wireless communication device as claimed in claim 13, wherein the second radiating portion includes a first portion, a second portion, and a third portion; the first portion, the second portion, and the third portion are coplanar; the first portion extends perpendicularly from the first edge of the second main portion; the first portion is spaced from the first section of the first radiating portion, thereby forming a gap between the first portion and the first section; the third portion is parallel to and spaced from the first portion; the second portion is positioned between and connected to ends of the first and third portions away from the first radiating portion; the second portion is perpendicular to the first and third portions.

15. The wireless communication device as claimed in claim 14, wherein the second radiating portion further comprises a fourth portion extending perpendicularly from an end of the third portion adjacent to the first radiating portion; the fourth portion extends towards to the gap to be aligned with the gap.

16. The wireless communication device as claimed in claim 15, further comprising a second grounding end and a fourth radiating portion; wherein the fourth radiating portion includes a first extending portion, a second extending portion, and a third extending portion; the first extending portion is spaced from and parallel to the first main portion; the second extending portion extends perpendicularly from an end of the first extending portion to be parallel to the second section; the third extending portion is coplanar with the second extending portion and extends perpendicularly from an end of the second extending portion away from the first extending portion to be located at a side of the second extending portion away from the second section; the second grounding end is connected to an opposite end of the first extending portion away from the second extending portion.

17. The wireless communication device as claimed in claim 10, wherein the third radiating portion further comprises a third extending section extending longitudinally from the end of the second extending section away from the second main portion to be collinear with the second extending section; the first grounding end is connected to an end of the third extending section away from the second extending section.

18. The wireless communication device as claimed in claim 10, wherein the first radiating portion receives and transmits wireless signals in central frequencies of 1710 MHz-2170 MHz; the second radiating portion receives and transmits wireless signals in central frequencies of 824 MHz-894 MHz; the third radiating portion receives and transmits wireless signals in central frequencies of 2520 MHz-2600 MHz.

* * * * *